US012577733B2

(12) United States Patent
Nakazawa et al.

(10) Patent No.: US 12,577,733 B2
(45) Date of Patent: Mar. 17, 2026

(54) METHOD FOR MANUFACTURING MOLDED PRODUCT

(71) Applicant: SEIKO EPSON CORPORATION, Tokyo (JP)

(72) Inventors: Masahiko Nakazawa, Matsumoto (JP); Shigemi Wakabayashi, Azumino (JP); Takashi Shinohara, Matsumoto (JP); Takumi Sago, Matsumoto (JP); Naoko Omagari, Azumino (JP); Masahide Nakamura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 181 days.

(21) Appl. No.: 18/466,029

(22) Filed: Sep. 13, 2023

(65) Prior Publication Data

US 2024/0093432 A1 Mar. 21, 2024

(30) Foreign Application Priority Data

Sep. 15, 2022 (JP) ..... 2022-146833

(51) Int. Cl.

| | |
|---|---|
| ***D21H 17/00*** | (2006.01) |
| ***D21F 11/06*** | (2006.01) |
| ***D21H 17/28*** | (2006.01) |
| ***D21H 21/52*** | (2006.01) |
| ***D21H 23/04*** | (2006.01) |

(52) U.S. Cl.

CPC ..... *D21H 17/74* (2013.01); *D21F 11/06* (2013.01); *D21H 17/28* (2013.01); *D21H 21/52* (2013.01); *D21H 23/04* (2013.01)

(58) Field of Classification Search

CPC ..... D21H 17/74; D21H 17/28; D21H 21/52; D21H 23/04; D21F 11/06

See application file for complete search history.

(56) References Cited

U.S. PATENT DOCUMENTS

| | | | | |
|---|---|---|---|---|
| 4,046,622 | A * | 9/1977 | Attwood | D21H 27/42 162/201 |
| 5,288,317 | A * | 2/1994 | Johansson | C08B 30/16 106/206.1 |
| 2003/0188738 | A1* | 10/2003 | Laleg | D21H 17/71 162/175 |
| 2021/0301106 | A1 | 9/2021 | Yokokawa et al. | |
| 2021/0363700 | A1 | 11/2021 | Yoshioka et al. | |
| 2022/0174998 | A1* | 6/2022 | Suzuki | A23L 7/109 |
| 2022/0288869 | A1 | 9/2022 | Wakabayashi et al. | |

FOREIGN PATENT DOCUMENTS

| | | | |
|---|---|---|---|
| EP | 3 974 579 | A1 | 3/2022 |
| JP | H05-246465 | A | 9/1993 |
| JP | 2021-183728 | A | 12/2021 |
| JP | 2022-138863 | A | 9/2022 |

* cited by examiner

*Primary Examiner* — Abbas Rashid
*Assistant Examiner* — Stephen M Russell
(74) *Attorney, Agent, or Firm* — Spencer Fane LLP

(57) ABSTRACT

A method for manufacturing a molded product of the present disclosure includes a deposition step of depositing a mixture including a fiber and starch in air, a humidification step of applying water to the mixture, and a molding step of heating and pressurizing the mixture applied with water to obtain a molded product. The starch has a gelatinized and then pulverized particle diameter d50 of 0.30 mm or more and 1.0 mm or less, which is the average particle diameter of the finely pulverized product determined by a prescribed measuring method.

8 Claims, 3 Drawing Sheets

METHOD FOR MANUFACTURING MOLDED PRODUCT

The present application is based on, and claims priority from JP Application Serial Number 2022-146833, filed Sep. 15, 2022, the disclosure of which is hereby incorporated by reference herein in its entirety.

BACKGROUND

1. Technical Field

The present disclosure relates to a method for manufacturing a molded product.

2. Related Art

Obtaining a sheet-like or film-like molded product by depositing a fibrous material and exerting a binding force between the deposited fibers has been performed for a long time. As a typical example thereof, manufacturing of paper by papermaking using water is mentioned. The paper manufactured by a papermaking method generally, for example, often has a structure in which the fibers of cellulose derived from wood or the like are entwined with each other and partially bound to each other by a binder.

However, since the papermaking method is a wet method, it is necessary to use a large amount of water and to perform dehydration, drying, and so on after formation of paper. Accordingly, a lot of energy and time is spent. Furthermore, the used water is required to be adequately treated as wastewater. Accordingly, it has become difficult to respond to recent requirements, such as energy saving and environmental protection. In addition, the apparatus to be used for the papermaking method often needs water, electricity, and a large-scale utility such as a drainage facility, and downsizing is difficult.

Accordingly, as a method that does not use a large amount of water unlike the known papermaking method, proposed has been a method for manufacturing a molded product, such as a buffer material, by adding mist-like water to a cotton-like material obtained by defibration of wastepaper, adding powdery or granular adhesive paste thereto, and performing molding and drying (for example, see JP-A-5-246465).

However, in the method described above, it is difficult to obtain a molded product excellent in the surface touch feeling. In addition, in the method described above, it may be difficult to sufficiently secure the strength of the obtained molded product. In particular, when paper is manufactured as a molded product, the paper is difficult to be stably fed through a printing machine or a printer. That is, the existing methods cannot give a molded product with both excellent surface touch feeling and strength.

SUMMARY

The present disclosure has been made to solve the above-mentioned problems and can be realized as the following application examples.

The method for manufacturing a molded product according to an application example of the present disclosure includes:

- a deposition step of depositing a mixture including a fiber and starch in air;
- a humidification step of applying water to the mixture; and

- a molding step of heating and pressurizing the mixture applied with water to obtain a molded product, wherein
- the starch has a gelatinized and then pulverized particle diameter d50 of 0.30 mm or more and 1.0 mm or less, which is an average particle diameter of a finely pulverized product determined by the following measuring method:

(Measuring Method)

A method including a step of adding a predetermined amount of water to the starch to give an aqueous solution of 18 mass %,

- a step of placing the aqueous solution (30 g) in an airtight container and heating the solution at 100° C. for 1 hour to obtain a gelatinized product,
- a step of heating and drying the gelatinized product at 100° C. for 3 hours in an open condition to obtain a solidified product,
- a step of roughly pulverizing the solidified product with a hammer and then removing coarse particles by a sieve with an opening of 3 mm to obtain a roughly pulverized product,
- a step of pulverizing the roughly pulverized product (3 g) using a mixer BM-RT-08 (manufactured by Zojirushi Corporation) for 1 minute to obtain the finely pulverized product, and
- a step of dispersing the finely pulverized product in ethanol and measuring the volume average particle diameter d50 with a particle size distribution measuring apparatus MT-3300EXII (manufactured by Microtrac-BEL Corporation).

DESCRIPTION OF EMBODIMENTS

Figure 1:
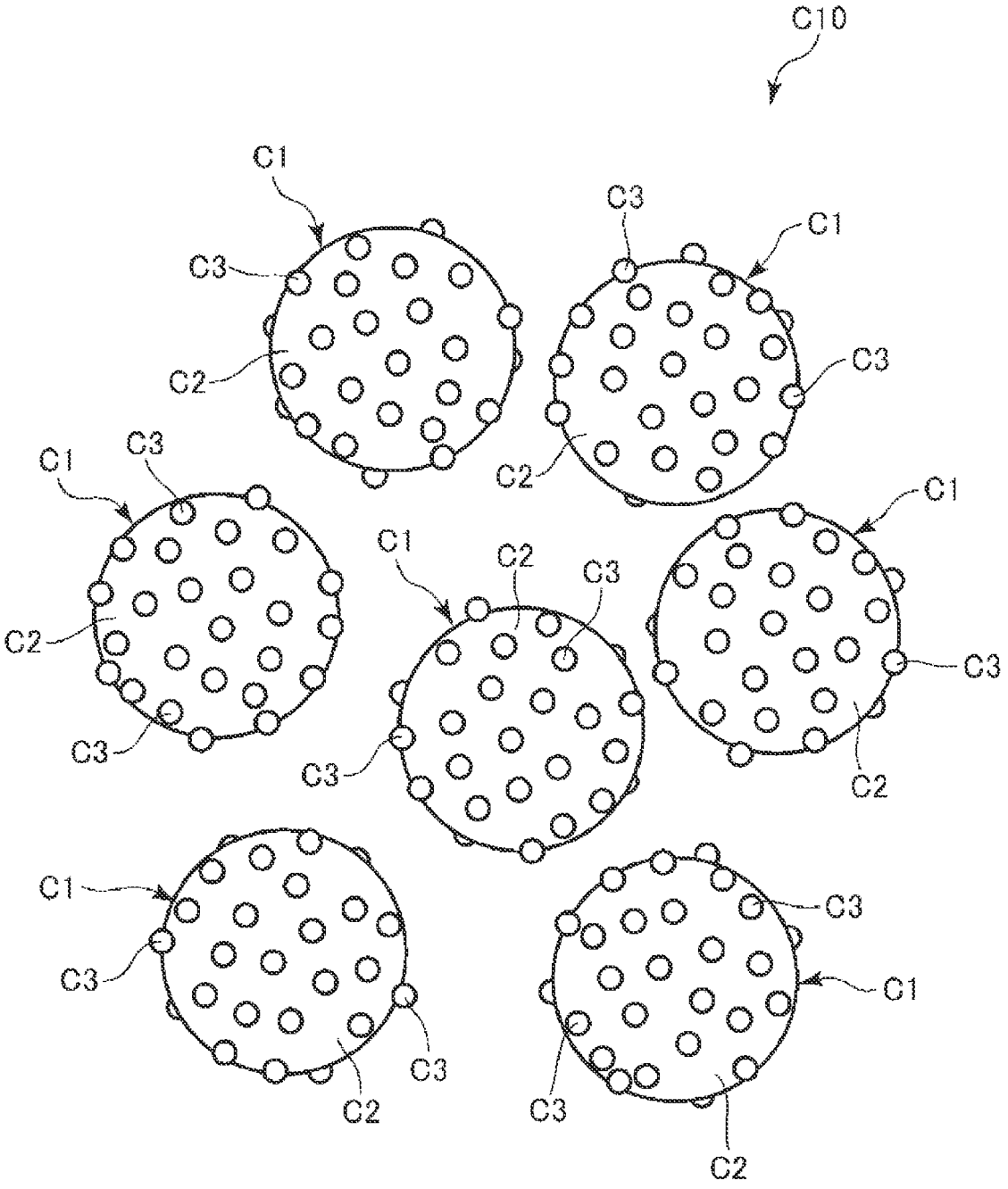
FIG. 1 is a view schematically showing a suitable embodiment of the complex to be used in the method for manufacturing a molded product of the present disclosure.

Suitable embodiments of the present disclosure will now be described in detail.

1. Method for Manufacturing Molded Product

A method for manufacturing a molded product of the present disclosure will be first described.

The method for manufacturing a molded product of the present disclosure includes a deposition step of depositing a mixture including a fiber and starch in air, a humidification step of applying water to the mixture, and a molding step of heating and pressurizing the mixture applied with water to obtain a molded product. The starch has a gelatinized and then pulverized particle diameter d50 of 0.30 mm or more and 1.0 mm or less, which is the average particle diameter of the finely pulverized product determined by the following measuring method. That is, the method for measuring the gelatinized and then pulverized particle diameter d50 as the average particle diameter of the finely pulverized product includes a step of adding a predetermined amount of water to the starch to give an aqueous solution of 18 mass %, a step of placing the aqueous solution (30 g) in an airtight container and heating the solution at 100° C. for 1 hour to obtain a gelatinized product, a step of heating and drying the gelatinized product at 100° C. for 3 hours in an open condition to obtain a solidified product, a step of roughly pulverizing the solidified product with a hammer and then removing coarse particles by a sieve with an opening of 3 mm to obtain a roughly pulverized product, a step of pulverizing the roughly pulverized product (3 g) using a mixer BM-RT-08 (manufactured by Zojirushi Corporation) for 1 minute to obtain the finely pulverized product, and a step of dispersing the finely pulverized product in ethanol and measuring the volume average particle diameter d50 with a particle size distribution measuring apparatus MT-3300EXII (manufactured by MicrotracBEL Corporation). Also in Examples described in detail later, the gelatinized and then pulverized particle diameter d50 of starch is determined as in above.

Consequently, it is possible to provide a molded product-manufacturing method that can manufacture a molded product with both excellent surface touch feeling and strength. In particular, in also a molded product obtained by repeating manufacturing of a molded product using, as a raw material, a composition obtained by treatment, such as disintegration, of a molded product constituted of a material including a fiber and starch, that is, in also a molded product as a recycled product obtained by repeating recycling, both excellent surface touch feeling and strength can be achieved.

It is inferred that such an excellent effect is obtained by the following reasons. That is, starch having a gelatinized and then pulverized particle diameter d50 within such a predetermined range has appropriate hardness, and the use of such starch causes stress concentration in the binding interface of a fiber and starch to easily cause interfacial peeling and to suitably disentangle the fiber. As a result, the molded product can be effectively prevented from containing undesirable aggregates of the fiber to make the smoothness and touch feeling of the molded product excellent. In addition, since the starch having a gelatinized and then pulverized particle diameter d50 within such a predetermined range does not have excessive hardness, the wetting and spreading to the fiber suitably progress in the molding step, and the adhesion area between the fiber and starch can be sufficiently secured. As a result, the molded product can have excellent strength.

In addition, a molded product having a desired shape can be suitably manufactured by using only a small amount of water. That is, the method can be suitably applied to a dry molding method. Accordingly, the method is advantageous also from the viewpoint of the productivity and production cost of the molded product, energy saving, downsizing of the facility for manufacturing the molded product, and so on. In the present specification, the "dry molding method" refers to a method in which a raw material for molding is not immersed in a liquid including water in the process of manufacturing a molded product, and a method using a small amount of water, such as a method of spraying a liquid including water to a raw material for molding and so on, is included in the dry molding method.

In contrast, when the above conditions are not satisfied, satisfactory results cannot be obtained. For example, in manufacturing of a molded product, when the starch is not used, when the humidification step is omitted, or when one of the heating and the pressurizing in the molding step is omitted, the strength of the molded product cannot be sufficiently excellent. In addition, the surface touch feeling of the manufactured molded product is also worsened.

When the starch is not used by using a non-starch binding material in place of the starch, at least one of the surface touch feeling and strength of the molded product is worsened.

When starch having a gelatinized and then pulverized particle diameter d50 of less than the above-mentioned lower limit is used, the hardness of the starch itself is insufficient, the fiber cannot be sufficiently disentangled, and the manufactured molded product includes many undesirable aggregates of the fiber. Consequently, the surface smoothness of the molded product is reduced, and the surface touch feeling is worsened.

When starch having a gelatinized and then pulverized particle diameter d50 of greater than the above-mentioned upper limit is used as the starch, the starch itself is excessively hard, the starch is less likely to wet and spread on the fiber in the molding step, the adhesion area between the fiber and the starch is difficult to be sufficiently secured, and the strength of the molded product is worsened.

It is inferred that the gelatinized and then pulverized particle diameter d50 is affected by, for example, various factors such as the average molecular weight and molecular weight distribution of the starch and the ratio and the position in the molecule of the branched-chain structure.

1-1. Deposition Step

In the deposition step, a mixture including a fiber and starch is deposited in air.

The mixture may be provided by mixing each component in advance or may be prepared by mixing in the deposition step.

The constitutional components of the mixture will now be described.

1-1-1. Fiber

The fiber is usually the main component of the molded product manufactured by the method for manufacturing a molded product of the present disclosure and is a component that highly contributes to maintenance of the shape of the molded product and that highly affects the characteristics such as the strength of the molded product.

The fiber may be constituted of any material and may be a material that can maintain the fibrous state even by heating in the molding step.

In particular, the fiber may be constituted of a material including at least one chemical structure selected from a hydroxy group, a carbonyl group, and an amino group.

Consequently, for example, a hydrogen bond is likely to be formed between the fiber and the starch, resulting in a more excellent bonding strength between the fiber and the starch and a more excellent strength as the whole molded product, for example, a more excellent tensile strength of a sheet-like molded product.

The fiber may be a synthetic fiber constituted of a synthetic resin such as polypropylene, polyester, or polyurethane, but can be a naturally derived fiber, i.e., a biomass-derived fiber or a cellulose fiber.

Consequently, more suitable corresponding to environmental problems, saving of underground resources, and so on is possible.

In particular, when the fiber is a cellulose fiber, the following effects are also obtained.

That is, cellulose is a plant-derived and abundant natural material, and the use of cellulose as the fiber further suitably corresponds to environmental problems, saving of reserve resources, and so on, and cellulose may be used from the viewpoint of stable supply of a molded product, a reduction in cost, and so on. In addition, among various types of fibers, the cellulose fiber theoretically has a particularly high strength and is advantageous also from the viewpoint of further improving the strength of the molded product.

The cellulose fiber is usually mainly constituted of cellulose but may include a component other than cellulose. Examples of such a component include hemicellulose and lignin.

In addition, the cellulose fiber may be one subjected to treatment such as bleaching.

In addition, the fiber may be one subjected to treatment such as UV irradiation treatment, ozone treatment, or plasma treatment. Consequently, the hydrophilicity of the fiber can be enhanced, and the affinity to the starch can be enhanced. More specifically, a functional group, such as a hydroxy group, can be introduced to the surface of the fiber by such treatment, and a hydrogen bond with the starch can be more efficiently formed.

The average length of the fiber is not particularly limited and may be 0.1 mm or more and 50 mm or less, 0.2 mm or more and 5.0 mm or less, or 0.3 mm or more and 3.0 mm or less.

Consequently, the stability of the shape, strength, and so on of the manufactured molded product can be further improved.

The average thickness of the fiber is not particularly limited and may be 0.005 mm or more and 0.5 mm or less or 0.010 mm or more and 0.05 mm or less.

Consequently, the stability of the shape, strength, and so on of the manufactured molded product can be further improved. In addition, occurrence of undesirable irregularities on the surface of the molded product can be more effectively prevented.

The average aspect ratio, i.e., the ratio of the average length to the average thickness, of the fiber is not particularly limited and may be 10 or more and 1,000 or less or 15 or more and 500 or less.

Consequently, the stability of the shape, strength, and so on of the manufactured molded product can be further improved. In addition, occurrence of undesirable irregularities on the surface of the manufactured molded product can be more effectively prevented.

The content rate of the fiber in the mixture that is subjected to the deposition step may be 88.0 mass % or more and 99.0 mass % or less, 89.0 mass % or more and 98.5 mass % or less, or 90.0 mass % or more and 98.0 mass % or less.

Consequently, both the surface touch feeling and strength of the finally obtained molded product can be achieved at higher levels.

1-1-2. Starch

The starch is a polymer material in which a plurality of α-glucose molecules are polymerized by glycoside bonds.

Although starch generally includes at least one of amylose and amylopectin, the "starch" in the present disclosure is a concept including a derivative and a denatured product, such as etherified starch and esterified starch.

The starch exerts a function as a binding material that exerts a binding force for binding the individual fibers by being applied with moisture.

Generally, starch is excellent also in biodegradability and has also a low environmental load.

Starch is a material that suitably exerts a binding force by progress of gelatinization by heating after application with moisture, i.e., a binding material that suitably exerts a binding force for binding individual fibers by being applied with moisture and does not exert an excessive binding force until being gelatinized and is therefore excellent also in the handleability. In addition, starch exerts a binding force by a noncovalent bond, such as a hydrogen bond, between fibers, in particular, fibers, such as cellulose fibers, constituted of a material having a functional group such as a hydroxy group, and since starch has an excellent binding force with fibers and shows excellent coatability for fibers, the manufactured molded product can have excellent strength and so on.

In the present disclosure, the starch included in the mixture to be subjected to deposition step has a gelatinized and then pulverized particle diameter d50 of 0.30 mm or more and 1.0 mm or less, which is the average particle diameter of the finely pulverized product determined by the above-described measuring method.

The gelatinized and then pulverized particle diameter d50 may be 0.30 mm or more and 1.0 mm or less, 0.33 mm or more and 0.80 mm or less, 0.36 mm or more and 0.70 mm or less, or 0.39 mm or more and 0.65 mm or less.

Consequently, the effects described above are more remarkably exerted.

In particular, the weight average molecular weight of the starch may be 50,000 or more and 400,000 or less, 70,000 or more and 300,000 or less, or 80,000 or more and 200,000 or less.

Consequently, the gelatinized and then pulverized particle diameter d50 can be easily adjusted to a value within the above-mentioned range. The starch can have more excellent water absorption efficiency, and even when the application amount of moisture is less, a molded product with a sufficient strength can be manufactured. More specifically, even when a small amount of water is applied, gelatinization by heating suitably progresses, the productivity of the molded product can be improved, and the strength of the manufactured molded product can be improved. The starch with a predetermined molecular weight as in above is particularly unlikely to cause undesirable denaturation by moisture application.

The starch thus controlled to have a weight average molecular weight value within a predetermined range can be suitably obtained by, for example, as follows. For example, starch controlled to have a weight average molecular weight value within a prescribed range can be obtained by suspending natural starch in water and then applying sulfuric acid, hydrochloric acid, or sodium hypochlorite on the suspension under a condition of not gelatinizing the starch. Alternatively, for example, starch controlled to have a weight average molecular weight value within a predetermined range can be obtained by, for example, heating natural starch to 120° C. to 180° C. directly or after addition of a very small amount of volatile acid, such as hydrochloric acid, diluted with water and thoroughly mixing, maturing, and drying at a low temperature. Alternatively, for example, starch controlled to have a weight average molecular weight value within a predetermined range can be suitably obtained by heating natural starch together with water and subjecting the resulting paste liquid to hydrolysis treatment with an acid or an enzyme.

The weight average molecular weight of starch can be determined by measurement by gel permeation chromatography.

The shape of the starch in the mixture that is subjected to the deposition step is not particularly limited and may be in a powdery shape including multiple particles.

Consequently, the fiber and the starch can be uniformly mixed, the moisture absorption in the humidification step more smoothly progresses, and the finally obtained molded product can have more excellent strength, surface touch feeling, and reliability.

The average particle diameter of the starch included in the mixture that is subjected to the deposition step may be 1.0

μm or more and 30.0 μm or less, 2.0 μm or more and 25.0 μm or less, or 3.0 μm or more and 20.0 μm or less.

Consequently, the fiber and the starch can be further uniformly mixed, the moisture absorption in the humidification step further smoothly progresses, and the finally obtained molded product can have further excellent strength, touch feeling, and reliability. Thus, the relatively small particle diameter of the starch increases the ratio of the surface area to the mass of the starch, resulting in more excellent water absorption efficiency of the starch. As a result, even when the application amount of moisture is less, a molded product with a sufficient strength can be manufactured. In addition, the fluidity and ease of handling of the starch are further improved.

In the present specification, the "average particle diameter" refers to the volume average particle diameter. The average particle diameter can be determined by, for example, dispersing the object in ethanol and performing measurement with a particle size distribution measuring apparatus MT-3300EXII (manufactured by MicrotracBEL Corporation).

The content rate of the starch in the mixture that is subjected to the deposition step may be 0.9 mass % or more and 11.0 mass % or less, 1.2 mass % or more and 10.5 mass % or less, or 1.8 mass % or more and 10.0 mass % or less.

Consequently, both the surface touch feeling and strength of the finally obtained molded product can be achieved at higher levels. In particular, in also a molded product obtained by repeating manufacturing of a molded product using, as a raw material, a composition obtained by treatment, such as disintegration, of a molded product constituted of a material including a fiber and starch, that is, in also a molded product as a recycled product obtained by repeating recycling, both surface touch feeling and strength can be achieved at higher levels. In addition, the raw material including starch in the manufacturing process of the molded product can be more smoothly transported.

1-1-3. Inorganic Oxide Particle

The mixture that is subjected to the deposition step may further include an inorganic oxide particle as long as the above-described fiber and starch are included.

Consequently, the surface of starch particles included in the mixture can be maintained in an appropriate dry state, and a loss of charge due to excessive moisture can be inhibited. As a result, undesirable aggregation of the starch in the mixture can be effectively prevented, and the productivity of the molded product and the strength of the finally obtained molded product can be more improved.

When the mixture that is subjected to the deposition step includes an inorganic oxide particle, the inorganic oxide particle may be included in the mixture, for example, in a non-contact manner with the particulate starch but may be in a contact with the surface of the particulate starch or may be fixed to the surface of particulate starch.

Consequently, a repulsive force acts between individual particles of the inorganic oxide particle, and aggregation of individual particles of the particulate starch is less likely to occur. The arrangement of the inorganic oxide particle can be confirmed with, for example, various electron microscopes.

A case of the mixture that is subjected to the deposition step includes a composite particle of the inorganic oxide particle adhering to the surface of the particulate starch, in particular, includes a complex as an aggregate of a plurality of the composite particles will be mainly described below.

FIG. 1 is a view schematically showing a suitable embodiment of the complex to be used in the method for manufacturing a molded product of the present disclosure.

As shown in FIG. 1, a complex C10 includes a composite particle C1 that includes a starch particle C2 constituted of a material including starch as described above and an inorganic oxide particle C3 in an integrated state. In the present specification, a state in which at least a part of the inorganic oxide particle C3 adheres to the surface or inside of the starch particle C2 to form the composite particle C1 is defined as "including in an integrated state", and it is not intended to exclude the complex C10 including a starch particle C2 and an inorganic oxide particle C3 that do not form the composite particle C1.

Although the composite particle C1 included in the complex C10 may be composed of a single particle of the starch particle C2 and a single particle of the inorganic oxide particle C3 adhered to the surface of the starch particle C2, the complex C10 may include, as the composite particle C1, a particle composed of a single particle of the starch particle C2 and a plurality of particles of the inorganic oxide particle C3 adhered to the surface of the starch particle C2.

Consequently, the effects described above are more remarkably exerted.

Examples of the constituent material of the inorganic oxide particle C3 include silica, alumina, zirconia, titanium oxide, magnetite, and ferrite. One or a combination of two or more selected therefrom can be used, and silica may be used.

Consequently, the effects described above are more remarkably exerted. Silica is a material that is less likely to adversely affect the color of the manufactured molded product. In particular, when the molded product is paper, such an effect is more remarkably exerted.

The average particle diameter of the inorganic oxide particle C3 may be 1 nm or more and 20 nm or less or 5 nm or more and 18 nm or less.

Consequently, the above-described effects by including the inorganic oxide particle C3 are more remarkably exerted. In addition, excessive irregularities can be suitably prevented from being generated on the surface of the composite particle C1, and the complex C10 can have more excellent fluidity. In addition, the inorganic oxide particle C3 is allowed to adhere better to the surface of the starch particle C2, undesirable detachment of the inorganic oxide particle C3 from the surface of the starch particle C2, undesirable burying of the inorganic oxide particle C3 into the inside of the starch particle C2, and so on can be more suitably prevented, and the effects by including the composite particle C1 can be more remarkably exerted.

The complex C10 may include the inorganic oxide particle C3 not adhering to the starch particle C2, in other words, may include the inorganic oxide particle C3 not constituting the composite particle C1, but the proportion of the inorganic oxide particle C3 constituting the composite particle C1 in the whole inorganic oxide particle C3 included in the complex C10 may be 50 mass % or more, 60 mass % or more, or 70 mass % or more.

Consequently, the effects described above are more remarkably exerted.

The inorganic oxide particle C3 may be mainly constituted of an inorganic material. In addition, the inorganic oxide particle C3 may have substantially the same composition at each position or may have positions having different compositions.

More specifically, for example, the mother particle of the inorganic oxide particle C3 may be surface-treated with at least one surface treatment agent. In other words, the inorganic oxide particle C3 may include a mother particle constituted of an inorganic oxide and a coating layer of a surface treatment agent coating the mother particle.

Consequently, for example, the undesirable aggregation of the starch particle C2 is further effectively prevented, the wetting and spreading of the starch on the fiber surface in the molding step are more improved, and the strength of the finally obtained molded product can be more improved.

A case of the complex C10 including a mother particle that is constituted of an inorganic material and a coating layer that is made of a surface treatment agent coating the mother particle as the inorganic oxide particle C3 will be mainly described below.

1-1-3-1. Mother Particle

The mother particle of the inorganic oxide particle C3, in other words, the base material surface-treated with a surface treatment agent in the inorganic oxide particle C3, is constituted of an inorganic oxide as described above.

The mother particle of the inorganic oxide particle C3 may include, for example, a component other than inorganic oxides, in addition to the inorganic oxide as long as the mother particle is mainly constituted of the inorganic oxide above.

However, the content rate of the inorganic oxide in the mother particle of the inorganic oxide particle C3 may be 90 mass % or more, 92 mass % or more, or 95 mass % or more.

1-1-3-2. Surface Treatment Agent

As described above, the inorganic oxide particle C3 may include a mother particle constituted of the inorganic oxide and a coating layer of a surface treatment agent coating the mother particle.

Desirable examples of the surface treatment agent include a fluorine-containing compound and a silicon-containing compound. The use of such a surface treatment agent can more suitably prevent aggregation of the starch particle C2 and the composite particle C1. In addition, the fluidity and ease of handling of the complex C10 are improved by including the inorganic oxide particle C3 surface-treated with the surface treatment agent mentioned above. Consequently, the productivity of the molded product can be particularly improved. In addition, the surface free energy of the inorganic oxide particle C3 can be more efficiently decreased. As a result, in the molding step, the complex C10 is likely to more suitably wet and spread on the surface of the fiber. Consequently, in the finally obtained molded product, the adhesion between the fiber and the starch is further improved, and the molded product can have a more excellent strength.

Examples of the fluorine-containing compound include perfluoropolyether and fluorine-modified silicone oil.

Examples of the silicon-containing compound include polydimethylsiloxane having a trimethylsilyl terminal, polydimethylsiloxane having a hydroxy terminal, polymethylphenylsiloxane, and various silicone oils such as amino-modified silicone oil, epoxy-modified silicone oil, carboxy-modified silicone oil, carbinol-modified silicone oil, polyether-modified silicone oil, and alkyl-modified silicone oil.

In particular, the surface treatment agent may be polydimethylsiloxane having a trimethylsilyl terminal. In other words, the inorganic oxide particle C3 may be one including a trimethylsilyl group on the surface.

Consequently, aggregation of the composite particle C1, the starch particle C2, and the inorganic oxide particle C3 can be more effectively prevented.

When the surface treatment agent is used, one type of a surface treatment agent may be used, or multiple types of surface treatment agents may be used.

When multiple types of surface treatment agents are used, multiple types of the surface treatment agents may be used for a single mother particle, or the complex C10 may include particles treated with surface treatment agents different from each other as the inorganic oxide particle C3.

The content rate of the surface treatment agent with respect to 100 parts by mass of the mother particle included in the complex C10 may be 0.5 parts by mass or more and 7 parts by mass or less or 1 part by mass or more and 5 parts by mass or less.

Consequently, the effects described above are more remarkably exerted.

The content rate of the inorganic oxide particle in the mixture that is subjected to the deposition step may be 0.01 mass % or more and 0.60 mass % or less, 0.02 mass % or more and 0.27 mass % or less, or 0.03 mass % or more and 0.15 mass % or less.

Consequently, for example, undesirable aggregation of the starch particle C2 is further effectively prevented, the wetting and spreading of the starch on the fiber surface in the molding step are more improved, and both the surface touch feeling and strength of the finally obtained molded product can be achieved at higher levels. In addition, the complex C10 in the manufacturing process of the molded product can be more smoothly transported.

1-1-4. Other Component

The mixture that is subjected to the deposition step may include a component other than the above.

Such a component is also referred to as "other component" in this section.

Examples of the other component include a binding material other than starch, an inorganic particle constituted of an inorganic material other the inorganic material above, and a color material such as a pigment, a dye, and a toner.

Examples of the binding material other than starch include naturally derived components, such as hyaluronic acid, natural gum paste (etherified tamarind gum, etherified locust bean gum, etherified guar gum, and acacia arabic gum), fiber derivative paste (etherified carboxymethyl cellulose and hydroxyethyl cellulose), seaweed (sodium alginate and agar), and animal proteins (collagen, gelatin, hydrolyzed collagen, and sericin); and polyvinyl alcohol, polyacrylic acid, and polyacrylamide. One or a combination of two or more selected from these materials can be used.

Examples of the inorganic material other than the inorganic oxide above include various metal materials; various metal compounds, such as a metal oxide, a metal nitride, a metal carbide, and a metal sulfide; various glass materials; and various carbon materials.

Examples of the metal material include single metals, such as Fe, Al, Cu, Ag, and Ni, and alloys including at least one of these metals.

Examples of the metal compound include various metal nitrides, metal carbides, and metal sulfides.

Examples of the glass material include soda glass, crystalline glass, quartz glass, lead glass, potassium glass, borosilicate glass, and non-alkali glass.

Examples of the carbon material include diamond, a carbon fiber, carbon black, a carbon nanotube, a carbon nanofiber, and a fullerene.

However, the content rate of the other component in the mixture that is subjected to the deposition step may be 2.0 mass % or less, 1.5 mass % or less, or 1.0 mass % or less.

1-2. Humidification Step

In the humidification step, water is applied to the deposited mixture to moisten.

Consequently, in the molding step described later, the bonding strength between the fiber and the starch and the bonding strength between the individual fibers via starch can be improved, and the strength and so on of the finally obtained molded product can be sufficiently improved. The smoothness of the surface of the finally obtained molded product can be more improved, and the surface touch feeling of the molded product can be more improved. In addition, the molding in the molding step can be suitably performed under relatively mild conditions. The deposition step and the humidification step may be simultaneously performed.

The method for humidifying the mixture is not particularly limited and may be performed in non-contact with the mixture, and examples thereof include a method of placing the mixture in a high humidity atmosphere, a method of allowing the mixture to pass through a high humidity space, a method of spraying a mist of liquid containing water to the mixture, and a method of allowing the mixture to pass through a space where a mist of liquid containing water floats, and one method or a combination of two or more methods selected from these methods can be performed. More specifically, the mixture can be humidified by, for example, using various humidifiers, such as a vaporization type and an ultrasonic type. The humidification of the mixture may be performed, for example, in multiple steps in the process of manufacturing a molded product. The liquid containing water may include, for example, a preservative, a fungicide, and a pesticide.

The amount of moisture to be applied to the mixture in the humidification step is not particularly limited, and the moisture may be applied in an amount of 12 parts by mass or more and 40 parts by mass or less, 15 parts by mass or more and 38 parts by mass or less, or 18 parts by mass or more and 35 parts by mass or less with respect to 100 parts by mass of the mixture that is subjected to the humidification step.

Consequently, a molded product with a sufficient strength can be manufactured with a remarkably small amount of moisture compared to known papermaking methods, and the effects of the present disclosure can be more remarkably exerted. Excessive wetting and spreading of starch can be more effectively inhibited by decreasing the amount of moisture to be applied, and as a result, the occurrence of fiber clumps can be more effectively inhibited.

1-3. Molding Step

In the molding step, the mixture humidified in the humidification step is heated and pressurized. Consequently, a molded product is obtained. The humidification step and the molding step may be simultaneously performed.

The heating temperature in the molding step is not particularly limited and may be 60° C. or more and 200° C. or less, 70° C. or more and 170° C. or less, or 90° C. or more and 110° C. or less.

Consequently, more suitable wetting and spreading of starch on the surface of the fiber are possible while effectively preventing undesirable degradation, denaturation, and so on of the constitutional components of the molded product, such as the fiber and the starch. As a result, the strength, touch feeling, and reliability of the manufactured molded product can be more improved. The excellent effects described above are thus obtained at relatively low heating temperature, which is caused by the use of starch that satisfies the conditions described above. In addition, such heating temperature is advantageous also from the viewpoint of energy saving.

The pressure to be applied to the mixture in the molding step, i.e., the pressure force, is not particularly limited and may be 0.2 MPa or more and 10.0 MPa or less or 0.3 MPa or more and 8.0 MPa or less.

Consequently, the starch can be more suitably wet and spread on the surface of the fiber while effectively preventing undesirable degradation, denaturation, and so on of the constitutional components of the molded product, such as the fiber and the fiber. As a result, the strength, touch feeling, and reliability of the manufactured molded product can be more improved. The excellent effects described above are thus obtained at relatively low pressure force, which is caused by the use of starch that satisfies the conditions described above. In addition, such pressure force is advantageous also from the viewpoint of energy saving.

This step can be performed, for example, using a heat press, a heating roller, or the like, and a pair of heating rollers may be used.

Consequently, there is no need to separately provide a pressure roller for pressurizing a mixture and a heating roller for heating the mixture, and heating and pressurizing of the mixture can be simultaneously performed with only a pair of heating rollers. Accordingly, the apparatus that is used for manufacturing can be downsized as a whole.

2. Apparatus for Manufacturing Molded Product

Figure 2:
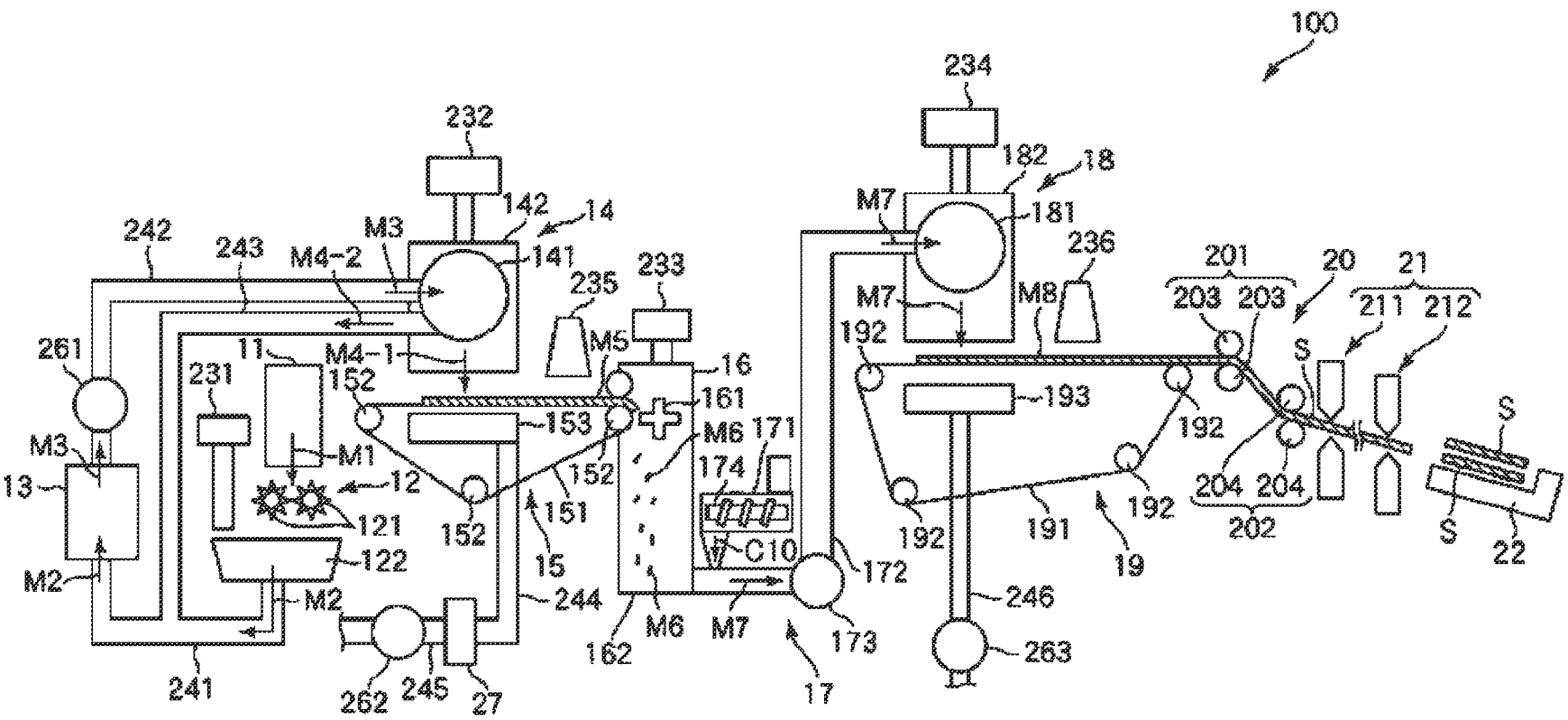
FIG. 2 is a schematic side view illustrating the structure of an apparatus for manufacturing a molded product of a suitable embodiment.
Figure 3:
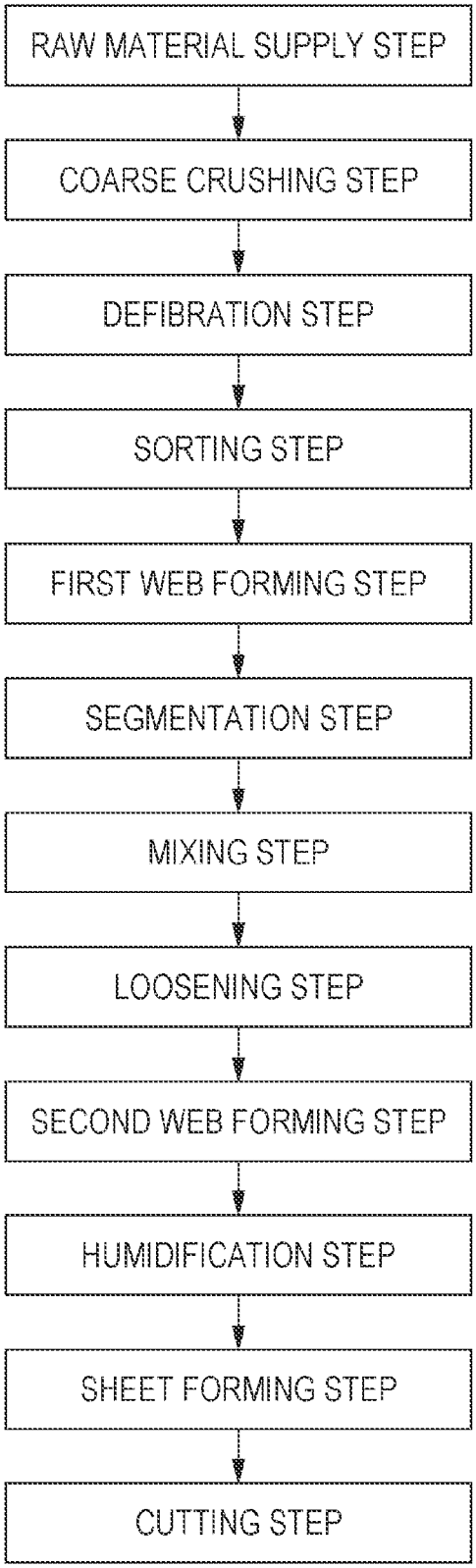
FIG. 3 is a diagram showing the steps implemented sequentially by the apparatus for manufacturing a molded product shown in FIG. 2.

An apparatus for manufacturing a molded product according to the present disclosure will now be described. FIG. 2 is a schematic side view illustrating the structure of an apparatus for manufacturing a molded product of a suitable embodiment. FIG. 3 is a diagram showing the steps implemented sequentially by the apparatus for manufacturing a molded product shown in FIG. 2. In the following, for convenience of description, the upper side in FIG. 2 is referred to as "upper" or "above", the lower side is referred to as "lower" or "below", the left side is referred to as "left" or "upstream", and the right side is referred to as "right" or "downstream".

In the following description, as an example of the apparatus for manufacturing a molded product, a sheet-manufacturing apparatus for manufacturing a sheet as the molded product will be described as an example.

As shown in FIG. 2, the sheet-manufacturing apparatus 100 as the apparatus for manufacturing a molded product includes a raw material supply unit 11, a coarse crushing unit 12, a defibration unit 13, a sorting unit 14, a first web forming unit 15, a fragmentation unit 16, a mixing unit 17, a loosening unit 18, a second web forming unit 19, a sheet forming unit 20, a cutting unit 21, and a stock unit 22. In addition, the sheet-manufacturing apparatus 100 includes a humidification unit 231, a humidification unit 232, a humidification unit 233, and a humidification unit 234.

The operation of each unit of the sheet-manufacturing apparatus 100 is controlled by a controller unit (not shown).

As shown in FIG. 3, in the present embodiment, the method for manufacturing a sheet as the molded product includes a raw material supply step, a coarse crushing step, a defibration step, a sorting step, a first web forming step, a segmentation step, a mixing step, a loosening step, a second web forming step, a humidification step, a sheet forming step, and a cutting step. The sheet-manufacturing apparatus 100 can implement these steps sequentially.

The structure of each unit of the sheet-manufacturing apparatus 100 will now be described.

The raw material supply unit 11 is a section for performing the raw material supply step of supplying a sheet-like material M1 to the coarse crushing unit 12. This sheet-like material M1 is a sheet-like material including a fiber such as a cellulose fiber.

The coarse crushing unit 12 is a section for performing the coarse crushing step of coarsely crushing the sheet-like material M1 supplied from the raw material supply unit 11 in a gas, such as air. The coarse crushing unit 12 includes a pair of primary crushing blades 121 and a hopper 122.

The pair of primary crushing blades 121 rotate to the opposite directions to each other and can coarsely crush, i.e., cut the sheet-like material M1 therebetween into a coarsely crushed piece M2. The shape and size of the coarsely crushed piece M2 may be those suitable for the defibration treatment in the defibration unit 13 and may be, for example, small pieces with a side length of 100 mm or less or small pieces with a side length of 10 mm or more and 70 mm or less.

The hopper 122 is disposed below the pair of primary crushing blades 121 and may be, for example, funnel-shaped. Consequently, the hopper 122 can receive the coarsely crushed piece M2 crushed by and falling from the primary crushing blades 121.

The humidification unit 231 is disposed above the hopper 122 to be adjacent to the pair of primary crushing blades 121. The humidification unit 231 humidifies the coarsely crushed piece M2 in the hopper 122. This humidification unit 231 includes a filter (not shown) including moisture and is constituted of a vaporizing humidifier which supplies humidified air having an increased humidity to the coarsely crushed piece M2 by allowing air to pass through the filter. The supply of humidified air to the coarsely crushed piece M2 can inhibit the coarsely crushed piece M2 from adhering to the hopper 122 and so on by static electricity.

The hopper 122 is connected to the defibration unit 13 through a tube 241 serving as a flow channel. The coarsely crushed piece M2 collected in the hopper 122 passes through the tube 241 and is transported to the defibration unit 13.

The defibration unit 13 is a section for performing the defibration step of defibrating the coarsely crushed piece M2 in a gas, such as air, i.e., by a dry process. A defibrated substance M3 is generated from the coarsely crushed piece M2 by defibration treatment in this defibration unit 13. Here, the term "defibration" means that a coarsely crushed piece M2 composed of multiple fibers bound to each other is loosened into individual fibers. This loosened material becomes the defibrated substance M3. The shape of the defibrated substance M3 is linear- or strip-shaped. The individual defibrated substances M3 may exist in a state of being intertwined and agglomerated, that is, in a state of forming a so-called "lump".

In the present embodiment, the defibration unit 13 is composed of, for example, an impeller mill including a rotor rotating at a high speed and an impeller mill having a liner located on the outer circumference of the rotor. The coarsely crushed piece M2 flowed into the defibration unit 13 is sandwiched between the rotor and the liner and is defibrated.

The defibration unit 13 can generate a flow of air, i.e., an airflow, from the coarse crushing unit 12 toward the sorting unit 14 by the rotation of the rotor. Consequently, the coarsely crushed piece M2 can be sucked from the tube 241 to the defibration unit 13. After the defibration treatment, the defibrated substance M3 can be sent to the sorting unit 14 through a tube 242.

In the middle of the tube 242, a blower 261 is provided. The blower 261 is an airflow generator that generates an airflow toward the sorting unit 14. Consequently, the sending out of the defibrated substance M3 to the sorting unit 14 is promoted.

The sorting unit 14 is a section for performing the sorting step of sorting the defibrated substance M3 depending on the length of each individual fiber. In the sorting unit 14, the defibrated substance M3 is sorted into a first sorted substance M4-1 and a second sorted substance M4-2 larger than the first sorted substance M4-1. The first sorted substance M4-1 has a size suitable for subsequent manufacturing of a sheet S. The second sorted substance M4-2 includes, for example, an insufficiently defibrated substance and excessively aggregated product of the defibrated individual fibers.

The sorting unit 14 includes a drum section 141 and a housing section 142 accommodating the drum section 141.

The drum section 141 is a sieve that is constituted of a cylindrically shaped net and rotates around the central axis thereof. The defibrated substance M3 flows into this drum section 141. By the rotation of the drum section 141, the defibrated substance M3 smaller than the opening of the net is sorted as a first sorted substance M4-1, and the defibrated substance M3 greater than or equal to the opening of the net is sorted as a second sorted substance M4-2. The first sorted substance M4-1 falls from the drum section 141.

On the other hand, the second sorted substance M4-2 is sent to a tube 243 that is a flow channel connected to the drum section 141. The tube 243 is connected to the tube 241 on the opposite side to the drum section 141, i.e., on the upstream. The second sorted substance M4-2 passed through the tube 243 joins to the coarsely crushed piece M2 in the tube 241 and flows into the defibration unit 13 together with the coarsely crushed piece M2. Consequently, the second sorted substance M4-2 is sent back to the defibration unit 13 and is subjected to defibration treatment together with the coarsely crushed piece M2.

The first sorted substance M4-1 from the drum section 141 falls while being dispersed in air toward the first web forming unit 15 that is a separation section located below the drum section 141. The first web forming unit 15 is a section performing the first web forming step of forming a first web M5 from the first sorted substance M4-1. The first web forming unit 15 includes a mesh belt 151 serving as a separation belt, three stretching rollers 152, and a suction section 153.

The mesh belt 151 is an endless belt, and the first sorted substance M4-1 deposits thereon. This mesh belt 151 is put around the three stretching rollers 152. The first sorted substance M4-1 on the mesh belt 151 is transported to the downstream by rotary drive of the stretching rollers 152.

The first sorted substance M4-1 has a size larger than or equal to the opening of the mesh belt 151. Consequently, the first sorted substance M4-1 is restricted from passing through the mesh belt 151 and can therefore deposit on the mesh belt 151. The first sorted substance M4-1 is transported to the downstream with the mesh belt 151 while being deposited on the mesh belt 151 and is therefore formed into a layered first web M5.

The first sorted substance M4-1 has a risk of, for example, being contaminated with dust, mote, and so on. The dust and mote may be mixed with the first sorted substance M4-1, for example, together with the sheet-like material M1 when the sheet-like material M1 is supplied to the coarse crushing unit 12 from the raw material supply unit 11. Such dust and mote are smaller than the opening of the mesh belt 151. Consequently, the dust and mote pass through the mesh belt 151 and further fall down.

The suction section 153 can suck air from below the mesh belt 151. Consequently, the dust and mote passed through the mesh belt 151 can be sucked together with air.

The suction section 153 is connected to a collection section 27 through a tube 244 serving as a flow channel. The dust and mote sucked in the suction section 153 are collected in the collection section 27.

The collection section 27 is further connected to a tube 245 serving as a flow channel. In the middle of the tube 245, a blower 262 is provided. By operating this blower 262, a suction force can be generated in the suction section 153. Consequently, formation of a first web M5 on the mesh belt 151 is promoted. In this first web M5, dust and mote have been removed. Dust and mote pass through the tube 244 by operation of the blower 262 and reach the collection section 27.

The housing section 142 is connected to the humidification unit 232. The humidification unit 232 is constituted of a vaporization humidifier that is similar to the humidification unit 231. Consequently, humidified air is supplied to the inside of the housing section 142. The first sorted substance M4-1 can be humidified by this humidified air. Accordingly, the first sorted substance M4-1 can also be inhibited from adhering to the inner wall of the housing section 142 by an electrostatic force.

A humidification unit 235 is disposed on the downstream of the sorting unit 14. The humidification unit 235 is constituted of an ultrasonic humidifier that sprays water. Consequently, moisture can be supplied to the first web M5, and thereby the amount of moisture of the first web M5 is adjusted. This adjustment can inhibit the first web M5 from attaching to the mesh belt 151 by an electrostatic force. Consequently, the first web M5 is easily peeled off from the mesh belt 151 at the position where the mesh belt 151 is folded back by the stretching roller 152.

The fragmentation unit 16 is disposed on the downstream of the humidification unit 235. The fragmentation unit 16 is a section for performing the segmentation step of segmenting the first web M5 peeled off from the mesh belt 151. The fragmentation unit 16 includes a rotatably supported propeller 161 and a housing section 162 accommodating the propeller 161. The first web M5 can be segmented by being wound in the rotating propeller 161. The segmented first web M5 becomes a fragment M6. The fragment M6 descends in the housing section 162.

The housing section 162 is connected to the humidification unit 233. The humidification unit 233 is constituted of a vaporization humidifier that is similar to the humidification unit 231. Consequently, humidified air is supplied to the inside of the housing section 162. This humidified air can prevent the fragment M6 from adhering to the propeller 161 and the inner wall of the housing section 162 by an electrostatic force.

The mixing unit 17 is disposed on the downstream of the fragmentation unit 16. The mixing unit 17 is a section for performing the mixing step of mixing the fragment M6 and the above-described composition including starch, in particular, the complex C10 in the configuration shown in the drawing. This mixing unit 17 includes a complex supply section 171 that supplies the composition including starch, in particular, the complex C10 in the configuration shown in the drawing, a tube 172 serving as a flow channel, and a blower 173.

The tube 172 connects between the housing section 162 of the fragmentation unit 16 and the housing section 182 of the loosening unit 18 and is a flow channel through which the mixture M7 of the fragment M6 and the complex C10 passes.

The complex supply section 171 is connected in the middle of the tube 172. The complex supply section 171 includes a screw feeder 174. The complex C10 can be supplied to the tube 172 by rotary drive of this screw feeder 174. The complex C10 supplied to the tube 172 is mixed with the fragment M6 to form a mixture M7.

The complex supply section 171 may supply, in addition to the complex C10, for example, a colorant for coloring the fiber, an aggregation inhibitor for inhibiting aggregation of the fiber and aggregation of the complex C10, and a flame retardant for making the fiber and so on difficult to burn.

In the middle of the tube 172, a blower 173 is provided on the downstream of the complex supply section 171. The blower 173 can generate an airflow toward the loosening unit 18. This airflow can stir the fragment M6 and the complex C10 in the tube 172. Consequently, the mixture M7 can flow into the loosening unit 18 in the state in which the fragment M6 and the complex C10 are uniformly dispersed. In addition, the fragment M6 in the mixture M7 is loosened to finer fibers in the process of passing through the tube 172.

The loosening unit 18 is a section for performing the loosening step of loosening individual fibers that are intertwined with each other in the mixture M7. The loosening unit 18 includes a drum section 181 and a housing section 182 accommodating the drum section 181.

The drum section 181 is a sieve that is constituted of a cylindrically shaped net and rotates around the central axis thereof. The mixture M7 flows into this drum section 181. In the mixture M7, individual fibers and so on that are smaller than the opening of the net can pass through the drum section 181 by the rotation of the drum section 181. On this occasion, the mixture M7 is loosened.

The mixture M7 loosened in the drum section 181 falls while being dispersed in air toward the second web forming unit 19 which is located below the drum section 181. The second web forming unit 19 is a section performing the second web forming step of forming a second web M8 from the mixture M7. The second web forming step in the present embodiment is a deposition step of depositing a mixture including the fiber and the complex C10. The second web forming unit 19 includes a mesh belt 191 serving as a separation belt, stretching rollers 192, and a suction section 193.

The mesh belt 191 is an endless belt, and the mixture M7 deposits thereon. This mesh belt 191 is put around four stretching rollers 192. The mixture M7 on the mesh belt 191 is transported to the downstream by rotary drive of the stretching rollers 192.

Most of the mixture M7 on the mesh belt 191 has a size of larger than or equal to the opening of the mesh belt 191. Consequently, the mixture M7 is restricted from passing through the mesh belt 191 and therefore can deposit on the mesh belt 191. In addition, the mixture M7 is transported to the downstream with the mesh belt 191 while being deposited on the mesh belt 191 and is therefore formed into a layered second web M8.

The suction section 193 can suck air from below the mesh belt 191. Consequently, the mixture M7 can be sucked on the mesh belt 191, and deposition of the mixture M7 on the mesh belt 191 is promoted.

The suction section 193 is connected to a tube 246 serving as a flow channel. In addition, in the middle of this tube 246, a blower 263 is provided. A suction force can be generated in the suction section 193 by operation of this blower 263.

The housing section 182 is connected to the humidification unit 234. The humidification unit 234 is constituted of a vaporization humidifier that is similar to the humidification unit 231. Consequently, humidified air is supplied to the inside of the housing section 182. The inside of the housing section 182 can be humidified by this humidified air, and thereby the mixture M7 can be prevented from adhering to the inner wall of the housing section 182 by an electrostatic force.

A humidification unit 236 is disposed on the downstream of the loosening unit 18. The humidification unit 236 is a section for performing the above-described humidification step. The humidification unit 236 is constituted of an ultrasonic humidifier that is similar to the humidification unit 235. Consequently, moisture can be supplied to the second web M8, and thereby the amount of moisture in the second web M8 is adjusted. This adjustment can optimize the binding force between the fiber and the starch in the sheet S as the finally obtained molded product. In addition, the second web M8 can be inhibited from attaching to the mesh belt 191 by an electrostatic force. Consequently, the second web M8 is easily peeled off from the mesh belt 191 at the position where the mesh belt 191 is folded back by the stretching roller 192.

The sheet forming unit 20 is disposed on the downstream of the second web forming unit 19. The sheet forming unit 20 is a section for performing the sheet forming step which is a molding step of forming a sheet S from the second web M8. This sheet forming unit 20 includes a pressurization section 201 and a heating section 202.

The pressurization section 201 includes a pair of calender rollers 203 and can pressurize the second web M8 therebetween without heating. Consequently, the density of the second web M8 is increased. This second web M8 is transported toward the heating section 202. One of the pair of calender rollers 203 is a driving roller that is driven by operation of a motor (not shown), and the other is a driven roller.

The heating section 202 includes a pair of heating rollers 204 and can pressurize the second web M8 therebetween while heating. The starch is melted in the second web M8 by this heating and pressurization, and individual fibers are bound to each other through this melted starch. Consequently, a sheet S is formed as a molded product. This sheet S is transported toward the cutting unit 21. One of the pair of heating rollers 204 is a driving roller that is driven by operation of a motor (not shown), and the other is a driven roller.

The cutting unit 21 is disposed on the downstream of the sheet forming unit 20. The cutting unit 21 is a section for performing the cutting step of cutting the sheet S. This cutting unit 21 includes a first cutter 211 and a second cutter 212.

The first cutter 211 cuts the sheet S in a direction intersecting the transport direction of the sheet S.

The second cutter 212 cuts the sheet S in a direction parallel to the transport direction of the sheet S on the downstream of the first cutter 211.

A sheet S as a molded product with a desired size can be obtained by the cutting with the first cutter 211 and the second cutter 212. This sheet S is further transported to the downstream and is stored in the stock unit 22.

3. Molded Product

The molded product according to the present disclosure will be then described.

The molded product according to the present disclosure is manufactured using the method for manufacturing a molded product of the present disclosure described above.

Consequently, a molded product having both excellent surface touch feeling and strength can be provided.

Each component included in the molded product according to the present disclosure may satisfy the same conditions as described in the paragraph "1-1" above.

The content rate of the fiber in the molded product may be 88.0 mass % or more and 99.0 mass % or less, 89.0 mass % or more and 98.5 mass % or less, and 90.0 mass % or more and 98.0 mass % or less.

Consequently, both the surface touch feeling and strength of the molded product can be achieved at higher levels. In particular, in also the molded product obtained by repeating manufacturing of a molded product using, as a raw material, a composition obtained by treatment, such as disintegration, of a molded product constituted of a material including a fiber and starch, that is, in also the molded product as a recycled product obtained by repeating recycling, both the surface touch feeling and strength can be achieved at higher levels.

The content rate of the starch in the molded product may be 0.9 mass % or more and 11.0 mass % or less, 1.2 mass % or more and 10.5 mass % or less, or 1.8 mass % or more and 10.0 mass % or less.

Consequently, both the surface touch feeling and strength of the molded product can be achieved at higher levels. In particular, in also a molded product obtained by repeating manufacturing of a molded product using, as a raw material, a composition obtained by treatment, such as disintegration, of a molded product constituted of a material including a fiber and starch, that is, in also a molded product as a recycled product obtained by repeating recycling, both surface touch feeling and strength can be achieved at higher levels.

The content rate of the inorganic oxide particle in the molded product may be 0.01 mass % or more and 0.60 mass % or less, 0.02 mass % or more and 0.27 mass % or less, or 0.03 mass % or more and 0.15 mass % or less.

Consequently, both the surface touch feeling and strength of the molded product can be achieved at higher levels. In particular, in also a molded product obtained by repeating manufacturing a molded product using, as a raw material, a composition obtained by treatment, such as disintegration, of a molded product constituted of a material including a fiber and starch, that is, in also a molded product as a recycled product obtained by repeating recycling, both the surface touch feeling and strength can be achieved at higher levels.

As described above, in the molded product according to the present disclosure, both excellent surface touch feeling and strength can be achieved.

The surface touch feeling is highly affected by the surface smoothness. In general, the more excellent the surface smoothness, the more excellent the surface touch feeling.

Regarding the surface of a molded product according to the present disclosure, the Bekk smoothness determined by measurement in accordance with JIS P8119: 1998 "Paper and paperboard—Determination of smoothness by Bekk smoothness tester" may be 7 seconds or more, 8 seconds or more, or 10 seconds or more.

Consequently, the surface touch feeling of the molded product is particularly excellent.

The shape of the molded product according to the present disclosure is not particularly limited and may be any shape, such as sheet-like, block-like, spherical, and three-dimensional solid shapes. The molded product according to the present disclosure may be in a sheet-like shape. The term "sheet-like" here refers to a molded product molded so as to have a thickness of 30 μm or more and 30 mm or less and a density of 0.05 g/cm$^3$ or more and 1.5 g/cm$^3$ or less.

Consequently, for example, the molded product can be suitably used as a recording medium or the like. In addition, more efficient manufacturing is possible by using an apparatus as described above.

When the molded product according to the present disclosure is a sheet-like recording medium, the thickness thereof may be 30 μm or more and 3 mm or less.

Consequently, the molded product can be more suitably used as a recording medium. In addition, more efficient manufacturing is possible by using an apparatus as described above.

When the molded product according to the present disclosure is a sheet-like recording medium, the density thereof may be 0.6 g/cm$^3$ or more and 0.9 g/cm$^3$ or less.

Consequently, the molded product can be more suitably used as a recording medium.

The molded product according to the present disclosure may further include an additional portion as long as it is at least partially manufactured by applying the method for manufacturing a molded product of the present disclosure described above. In addition, after the steps described in the method for manufacturing a molded product of the present disclosure, post treatment may be performed.

The use of the molded product according to the present disclosure is not particularly limited, and examples thereof include a recording medium, a liquid absorber, a buffer material, and a sound absorber.

Suitable embodiments of the present disclosure have been described above, but the present disclosure is not limited thereto.

For example, the method for manufacturing a molded product of the present disclosure may further include another step as long as the deposition step, the humidification step, and the molding step are included.

In the embodiment described above, a case of using a complex including a composite particle composed of the starch particle and the inorganic oxide particle adhering to the surface thereof together with the fiber has been mainly described, but as long as the fiber and the starch are used, the complex as described above need not be used, and the inorganic oxide particle need not be used.

Each unit constituting the sheet-manufacturing apparatus can be replaced with any configuration that can exert the same function. In addition, any component may be added to the apparatus.

The molded product according to the present disclosure is not limited to those manufactured with the above-described apparatus and may be manufactured with any apparatus.

EXAMPLE

Specific examples of the present disclosure will now be described.

4. Preparation of Complex

Preparation Example 1

Lustergen FO (manufactured by Nippon Starch Chemical Co., Ltd.) as a starch powder was pulverized using a pulverizer (Counter jet mill AFG-CR, manufactured by Hosokawa Micron Corp.) to an average particle diameter of 5.0 μm.

Subsequently, this pulverized product of starch was loaded in a Henschel mixer (FM mixer (FM 20C/I), manufactured by Nippon Colke & Engineering Co., Ltd.), and 1 part by mass of fumed silica (DM-10, manufactured by Tokuyama Corporation) having a dimethylsilyl group on the surface was added thereto as an inorganic oxide particle with respect to 100 parts by mass of the starch, followed by a stirring treatment at a frequency of 60 Hz for 10 minutes to prepare a complex.

The thus-obtained complex included a composite particle composed of the starch particle and the fumed silica as an inorganic particle adhered to the surface of the starch particle. The inorganic particle included in the complex had an average particle diameter of 14 nm, and the starch particle included in the complex had an average particle diameter of 5.0 μm.

Preparation Examples 2 to 8

Complexes were prepared as in Preparation Example 1 except that the types of the starch and inorganic oxide particle as raw materials were those shown in Table 1 to give configurations shown in Table 1.

The configurations of the complexes obtained in the Preparation Examples are collectively shown in Table 1. In Table 1, "S1" means Lustergen FO (manufactured by Nippon Starch Chemical Co., Ltd.) which is starch having a gelatinized and then pulverized particle diameter d50 of 0.30 mm; "S2" means STARBOND 05 (manufactured by General Starch Japan Co., Ltd.) which is starch having a gelatinized and then pulverized particle diameter d50 of 0.40 mm; "S3" means HSS Coat (manufactured by Oji Cornstarch Co., Ltd.) which is starch having a gelatinized and then pulverized particle diameter d50 of 0.60 mm; "S4" means SQ 330 (manufactured by Nippon Starch Chemical Co., Ltd.) which is starch having a gelatinized and then pulverized particle diameter d50 of 1.00 mm; "S5" means Lustergen FK (manufactured by Nippon Starch Chemical Co., Ltd.) which is starch having a gelatinized and then pulverized particle diameter d50 of 0.12 mm; "S6" means 68NBL (manufactured by General Starch Japan Co., Ltd.) which is starch having a gelatinized and then pulverized particle diameter d50 of 0.18 mm; "S7" means SK-200 (manufactured by Japan Cornstarch Co., Ltd.) which is starch having a gelatinized and then pulverized particle diameter d50 of 0.25 mm; "S8" means Delica WH (manufactured by Nippon Starch Chemical Co., Ltd.) which is starch having a gelatinized and then pulverized particle diameter d50 of 1.20 mm; "DM-10" means fumed silica (DM-10, manufactured by Tokuyama Corporation) which is an inorganic oxide particle having a dimethylsilyl group on the surface and having an average particle diameter of 14 nm; "HM-30S" means fumed silica (HM-305, manufactured by Tokuyama Corporation) which is an inorganic oxide particle having a trimethylsilyl group on the surface and having an average particle diameter of 7 nm; "ZD-30ST" means fumed silica (ZD-30ST, manufactured by Tokuyama Corporation) which is an inorganic oxide particle having a trimethylsilyl group on the surface and having an average particle diameter of 7 nm; "AluC" means fumed alumina (AEROXIDE Alu-C, manufactured by Nippon Aerosil Co., Ltd.) which is an inorganic oxide particle having a trimethylsilyl group on the surface and having an average particle diameter of 7 nm; and "NKT90" means fumed titania (AEROXIDE NKT 90, manufactured by Nippon Aerosil Co., Ltd.) which is an inorganic oxide particle having a trimethylsilyl group on the surface and having an average particle diameter of 7 nm. In all of Preparation Examples 1 to 8 above, the proportion of the starch particle constituting the composite particle to the total starch particles included in the complex was 90 mass % or more, and the proportion of the inorganic oxide particle constituting the composite particle to the total inorganic oxide particles included in the complex was 90 mass % or more.

TABLE 1

| | Starch particle | | | | Inorganic oxide particle | | | | | Composite particle |
|---|---|---|---|---|---|---|---|---|---|---|
| | Type of starch | Pulverized particle diameter after gelatinization d50 [mm] | Average particle diameter [μm] | Content rate [mass %] | Type | Type of mother particle | Surface treatment | Average particle diameter [nm] | Content rate [mass %] | Average particle diameter [μm] |
| Preparation Example 1 | S1 | 0.30 | 5.0 | 98.5 | DM-10 | Silica | Dimethylsilyl | 14 | 1.5 | 5.0 |
| Preparation Example 2 | S2 | 0.40 | 5.0 | 98.5 | HM-30S | Silica | Trimethylsilyl | 7 | 1.5 | 5.0 |
| Preparation Example 3 | S3 | 0.60 | 5.0 | 98.5 | ZD-30ST | Silica | Trimethylsilyl | 7 | 1.5 | 5.0 |
| Preparation Example 4 | S4 | 1.0 | 5.0 | 98.5 | ZD-30ST | Silica | Trimethylsilyl | 7 | 1.5 | 5.0 |
| Preparation Example 5 | S5 | 0.12 | 5.0 | 98.5 | ZD-30ST | Silica | Trimethylsilyl | 7 | 1.5 | 5.0 |
| Preparation Example 6 | S6 | 0.18 | 5.0 | 98.5 | ZD-30ST | Silica | Trimethylsilyl | 7 | 1.5 | 5.0 |
| Preparation Example 7 | S7 | 0.25 | 5.0 | 98.5 | AluC | Alumina | Trimethylsilyl | 7 | 1.5 | 5.0 |
| Preparation Example 8 | S8 | 1.2 | 5.0 | 98.5 | NKT90 | Titania | Trimethylsilyl | 7 | 1.5 | 5.0 |

5. Manufacturing Sheet as Molded Product

Example 1

In the present Example, a recycled sheet as a molded product was manufactured using the complex prepared in Preparation Example 1 as follows.

First, a sheet-manufacturing apparatus as shown in FIG. 2 was provided, and commercially available copy paper (GR70-W, manufactured by FUJIFILM Business Innovation Corp.) was provided as a sheet-like material serving as a fiber source.

Subsequently, the sheet-like material provided above was supplied to the raw material supply unit of the sheet-manufacturing apparatus, and the complex prepared in Preparation Example 1 was supplied to the complex supply section. Then, the sheet-manufacturing apparatus was driven to perform a coarse crushing step, a defibration step, a sorting step, a first web forming step, a segmentation step, a mixing step, a loosening step, a second web forming step as a deposition step, a humidification step, a sheet forming step as a molding step, and a cutting step. Thus, an A4 size sheet was manufactured as a molded product. The resulting sheet had a basis weight of 90 g/m$^2$.

On this occasion, the sheet as the molded product was adjusted to include 6 parts by mass of the complex prepared in Preparation Example 1 with respect to 94 parts by mass of the fiber as raw materials. In addition, in the humidification step, it was adjusted such that 20 parts by mass of moisture was applied with respect to 100 parts by mass of the mixture that would be subjected to the humidification step. The heating temperature when heating and pressurization were performed in the heating section was adjusted to 80° C., and the pressure when heating and pressurization were performed in the heating section was adjusted to 0.5 MPa.

Subsequently, the sheet obtained as described above was used as a sheet-like material serving as a fiber source, and as in above, an A4 size recycled sheet was manufactured as a molded product using a sheet-manufacturing apparatus as shown in FIG. 2. The resulting recycled sheet had a basis weight of 90 g/m$^2$.

On this occasion, raw materials were adjusted such that the finally obtained recycled sheet included 6 parts by mass of the complex prepared in Preparation Example 1 with respect to 94 parts by mass of the fibers. In the humidification step, it was adjusted such that 20 parts by mass of moisture was applied with respect to 100 parts by mass of the mixture that would be subjected to the humidification step. The heating temperature when heating and pressurization were performed in the heating section was adjusted to 80° C., the pressure when heating and pressurization were performed in the heating section was adjusted to 0.5 MPa, and the heating and pressurizing time when the heating and pressurization were performed in the heating section was adjusted to 15 seconds.

Examples 2 to 4

A4 size recycled sheets were manufactured as molded products as in Example 1 except that complexes shown in Table 2 were used instead of that prepared in Preparation Example 1.

Examples 5 to 11

A4 size recycled sheets were manufactured as molded products as in Example 2 except that the compounding ratio of the complex and the fiber was changed such that the content rate of each component in the recycled sheet as the finally obtained molded product was that shown in Table 2.

Comparative Examples 1 to 4

A4 size recycled sheets were manufactured as molded products as in Example 1 except that those shown in Table 2 were used as the complexes instead of that prepared in the Preparation Example 1.

The conditions for manufacturing the molded products of Examples and Comparative Examples are collectively shown in Table 2.

TABLE 2

| | Complex used | Humidification condition in humidification step Moisture amount applied to 100 parts by mass of mixture [part by mass] | Content rate of component constituting recycled sheet [mass %] Fiber | Starch | Inorganic oxide particle |
|---|---|---|---|---|---|
| Example 1 | Preparation Example 1 | 20 | 94.000 | 5.910 | 0.090 |
| Example 2 | Preparation Example 2 | 20 | 94.000 | 5.910 | 0.090 |
| Example 3 | Preparation Example 3 | 20 | 94.000 | 5.910 | 0.090 |
| Example 4 | Preparation Example 4 | 20 | 94.000 | 5.910 | 0.090 |
| Example 5 | Preparation Example 2 | 20 | 99.000 | 0.985 | 0.015 |
| Example 6 | Preparation Example 2 | 20 | 98.000 | 1.970 | 0.030 |
| Example 7 | Preparation Example 2 | 20 | 97.000 | 2.955 | 0.045 |
| Example 8 | Preparation Example 2 | 20 | 96.000 | 3.940 | 0.060 |
| Example 9 | Preparation Example 2 | 20 | 94.000 | 5.910 | 0.090 |
| Example 10 | Preparation Example 2 | 20 | 92.000 | 7.980 | 0.120 |
| Example 11 | Preparation Example 2 | 20 | 90.000 | 9.850 | 0.150 |
| Comparative Example 1 | Preparation Example 5 | 20 | 94.000 | 5.910 | 0.090 |
| Comparative Example 2 | Preparation Example 6 | 20 | 94.000 | 5.910 | 0.090 |
| Comparative Example 3 | Preparation Example 7 | 20 | 94.000 | 5.910 | 0.090 |
| Comparative Example 4 | Preparation Example 8 | 20 | 94.000 | 5.910 | 0.090 |

6. Evaluation of Recycled Sheet as Molded Product 6-1. Strength

A strip of 100 mm×20 mm was cut out from the recycled sheet manufactured as a molded product in each of Examples and Comparative Examples, and the breaking strength of the strip in the longitudinal direction was measured. The breaking strength was measured using Autograph AGS-1N manufactured by Shimadzu Corporation at a tension rate of 20 ram/sec, and the specific tensile strength was calculated therefrom and was evaluated based on the following criteria. It can be said that the larger the specific tensile strength, the better the strength.

A: the specific tensile strength is 40 Nm/g or more,

B: the specific tensile strength is 30 Nm/g or more and less than 40 Nm/g,

C: the specific tensile strength is 20 Nm/g or more and less than 30 Nm/g, and

D: the specific tensile strength is less than 20 Nm/g.

6-2. Surface Smoothness

The surface, in particular, the upper surface in FIG. 2, of the recycled sheet as the molded product manufactured in each of Examples and Comparative Examples was subjected to measurement in accordance with JIS P8119: 1998 "Paper and paperboard—Determination of smoothness by Bekk smoothness tester" to determine the Bekk smoothness using Bekk smoothness testing machine HK-type manufactured by Kumagai Riki Kogyo Co., Ltd., followed by evaluation based on the following criteria. It can be said that the larger the value of the Bekk smoothness, the better the smoothness and the better the touch feeling.

A: the Bekk smoothness is 10 seconds or more,

B: the Bekk smoothness is 7 seconds or more and less than 10 seconds, and

C: the Bekk smoothness is less than 7 seconds.

6-3. Touch Feeling

The touch feeling when the surface, in particular, the upper surface in FIG. 2, of the recycled sheet as the molded product manufactured in each of Examples and Comparative Examples was stroked with a finger and was evaluated based on the following criteria.

A: it is extremely smooth and has a particularly excellent touch feeling,

B: it does not give rough feeling and has sufficiently excellent touch feeling, and C: it gives rough feeling and is inferior in touch feeling.

These results are collectively shown in Table 3.

TABLE 3

| | Strength | Surface smoothness | Touch feeling |
|---|---|---|---|
| Example 1 | A | B | B |
| Example 2 | B | A | A |
| Example 3 | B | A | A |
| Example 4 | C | A | A |
| Example 5 | C | A | A |
| Example 6 | B | A | A |
| Example 7 | B | A | A |
| Example 8 | B | A | A |
| Example 9 | B | A | A |
| Example 10 | A | B | B |
| Example 11 | A | B | B |
| Comparative Example 1 | A | C | C |
| Comparative Example 2 | A | C | C |
| Comparative Example 3 | A | C | C |
| Comparative Example 4 | D | A | A |

As obvious from Table 3, excellent results were obtained in the present disclosure. In contrast, in Comparative Examples, no satisfactory results were obtained.

Molded products were manufactured as in Examples above except that the heating temperature in the molding step was variously changed within a range of 60° C. or more and 200° C. or less. The recycled sheets as these finally obtained molded products were subjected to the same evaluations as above, and the same results as above were obtained. In addition, molded products were manufactured as in Examples above except that the pressure to be applied to the mixture in the molding step was variously changed within a range of 0.2 MPa or more and 10.0 MPa or less. The recycled sheets as these finally obtained molded products were subjected to the same evaluations as above, and the same results as above were obtained.

What is claimed is:

1. A method for manufacturing a molded product, comprising:

a deposition step of depositing a mixture including a fiber and starch in air;

a humidification step of applying water to the mixture; and a molding step of heating and pressurizing the mixture applied with water to obtain a molded product, wherein the starch has a gelatinized and then pulverized particle diameter d50 of 0.30 mm or more and 1.0 mm or less, which is an average particle diameter of a finely pulverized product determined by a following measuring method comprising:

adding a predetermined amount of water to the starch to give an aqueous solution of 18 mass %;

placing 30 g of the aqueous solution in an airtight container and heating the solution at 100° C. for 1 hour to obtain a gelatinized product;

heating and drying the gelatinized product at 100° C. for 3 hours in an open condition to obtain a solidified product;

roughly pulverizing the solidified product with a hammer and then removing coarse particles by a sieve with an opening of 3 mm to obtain a roughly pulverized product;

pulverizing 3 g of the roughly pulverized product using a mixer BM-RT-08 (manufactured by Zojirushi Corporation) for 1 minute to obtain a finely pulverized product, and dispersing the finely pulverized product in ethanol and measuring a volume average particle diameter d50 with a particle size distribution measuring apparatus MT-3300EXII (manufactured by MicrotracBEL Corporation).

2. The method for manufacturing a molded product according to claim 1, wherein a content rate of the starch in the molded product is 0.9 mass % or more and 11.0 mass % or less.

3. The method for manufacturing a molded product according to claim 1, wherein heating temperature of the mixture in the molding step is 60° C. or more and 200° C. or less.

4. The method for manufacturing a molded product according to claim 1, wherein the molding step is performed using a pair of heating rollers.

5. The method for manufacturing a molded product according to claim 1, wherein pressure force in the molding step is 0.2 MPa or more and 10.0 MPa or less.

6. The method for manufacturing a molded product according to claim 1, wherein an amount of water applied to the mixture in the humidification step is 12 parts by mass or more and 40 parts by mass or less with respect to 100 parts by mass of the mixture that is subjected to the humidification step.

7. The method for manufacturing a molded product according to claim 1, wherein the starch included in the mixture that is subjected to the deposition step is a particle having an average particle diameter of 1.0 μm or more and 30.0 μm or less.

8. The method for manufacturing a molded product according to claim 1, wherein the mixture that is subjected to the deposition step further comprises an inorganic oxide particle.

* * * * *